US005626184A

United States Patent [19]

Campbell et al.

[11] Patent Number: 5,626,184

[45] Date of Patent: May 6, 1997

[54] SOOTBLOWER

[75] Inventors: Barry E. Campbell, Canisteo, N.Y.; Harlan E. Finnemore, Pocatello, Id.

[73] Assignee: ABB Air Preheater, Inc., Wellsville, N.Y.

[21] Appl. No.: 518,797

[22] Filed: Aug. 24, 1995

[51] Int. Cl.[6] ..... F23L 15/02

[52] U.S. Cl. ..... 165/8; 165/5

[58] Field of Search ..... 165/5, DIG. 12, 165/DIG. 11, 95; 15/312.1, 301; 432/75

[56] References Cited

U.S. PATENT DOCUMENTS

| | | | |
|---|---|---|---|
| 2,232,000 | 2/1941 | Hall | 165/5 |
| 2,379,506 | 4/1945 | Yerrick et al. | 165/5 |
| 2,761,653 | 9/1956 | Grames et al. | 165/5 |
| 3,144,900 | 8/1964 | Stockman | 165/5 |
| 3,233,661 | 2/1966 | Firgau et al. | 165/5 |
| 4,428,417 | 1/1984 | Chesner | 165/5 |
| 4,850,423 | 7/1989 | Allen et al. | 165/5 |

*Primary Examiner*—John Rivell
*Assistant Examiner*—Christopher Atkinson
*Attorney, Agent, or Firm*—Chilton, Alix & Van Kirk

[57] ABSTRACT

A swing-arm sootblower for a rotary regenerative air preheater is mounted to sweep across the air preheater rotor at a constant speed or angular velocity. A constant speed motor is attached through a speed reducer to a drive sprocket. A chain drive turns driven sprocket which is connected to the rotatable mounting shaft for the sootblower lance or arm. Limit switches are tripped at the ends of the arc of travel of the lance by a trip arm mounted on the drive sprocket to turn the motor off and to close a valve for the sootblowing medium. The speed of the lance can be adjusted in general or at particular points in the art of travel.

8 Claims, 5 Drawing Sheets

SOOTBLOWER

BACKGROUND OF THE INVENTION

The present invention relates to sootblowers for rotary regenerative air preheaters and particularly to a swing-arm sootblower which is driven at a constant speed or angular velocity across the air preheater rotor.

Soot or other related materials from flue gases tend to deposit over a period of time on the heat transfer surface of the rotor of a rotary regenerative air preheater. As these deposits build up, the flow paths for the air and flue gas become blocked and the heat transfer capacity is reduced. Therefore, it is common for these air preheaters to include devices for blowing air or steam at high velocities into the rotor to dislodge the deposits.

The typical sootblower for a rotary regenerative air preheater employs a swing-arm mounted for rotation through a set angle or arc with one or more nozzles at the end which blow the sootblowing medium (air or steam) onto the rotor as the rotor turns and as the swing-arm rotates through the arc. The sootblower is normally mounted on the cold end of the rotor which is the outlet end for the flue gas.

The prior art sootblowers have employed a drive mechanism which includes a worm gear and a worm wheel which rotates a lever throw arm. A connecting link attaches the lever throw arm to a lever attached to the sootblower arm mounting plate. This linkage arrangement causes the lever and the sootblower mounting plate to reciprocate back and forth through an arc. This also results in the swing-arm sootblower to constantly change speed or angular velocity as it sweeps across the rotor. At the beginning and end of its sweep, the velocity is zero with the maximum velocity being at the center of the sweep. Between the center of the sweep and the beginning and end, the velocity is constantly speeding up or slowing down due to the linkage arrangement. Therefore, the energy of the sootblowing medium is concentrated towards the two ends of the nozzle travel. This causes a more rapid deterioration of the heat exchange elements in the rotor usually toward the center and outside periphery of the rotor. This type of prior art sootblower is schematically illustrated in the drawings and will be further explained hereinafter.

SUMMARY OF THE INVENTION

The present invention is directed to a swing-arm sootblower for a rotary regenerative air preheater which is swept across the air preheater rotor at a constant angular velocity from the beginning to the end of the sweep. The swing-arm sootblower of the present invention employs a constant speed drive assembly adapted to rotate a drive sprocket, preferably with a torque-limiter clutch. The drive sprocket is positively connected to a driven sprocket, such as by a drive chain with the driven sprocket being mounted on a swivel shaft to which the sootblower arm or lance is attached. Means such as limit switches terminate the swivel of the sootblower arm at the ends of its arc of travel and turn off the sootblowing medium.

DESCRIPTION OF THE PREFERRED EMBODIMENTS

Figure 1:
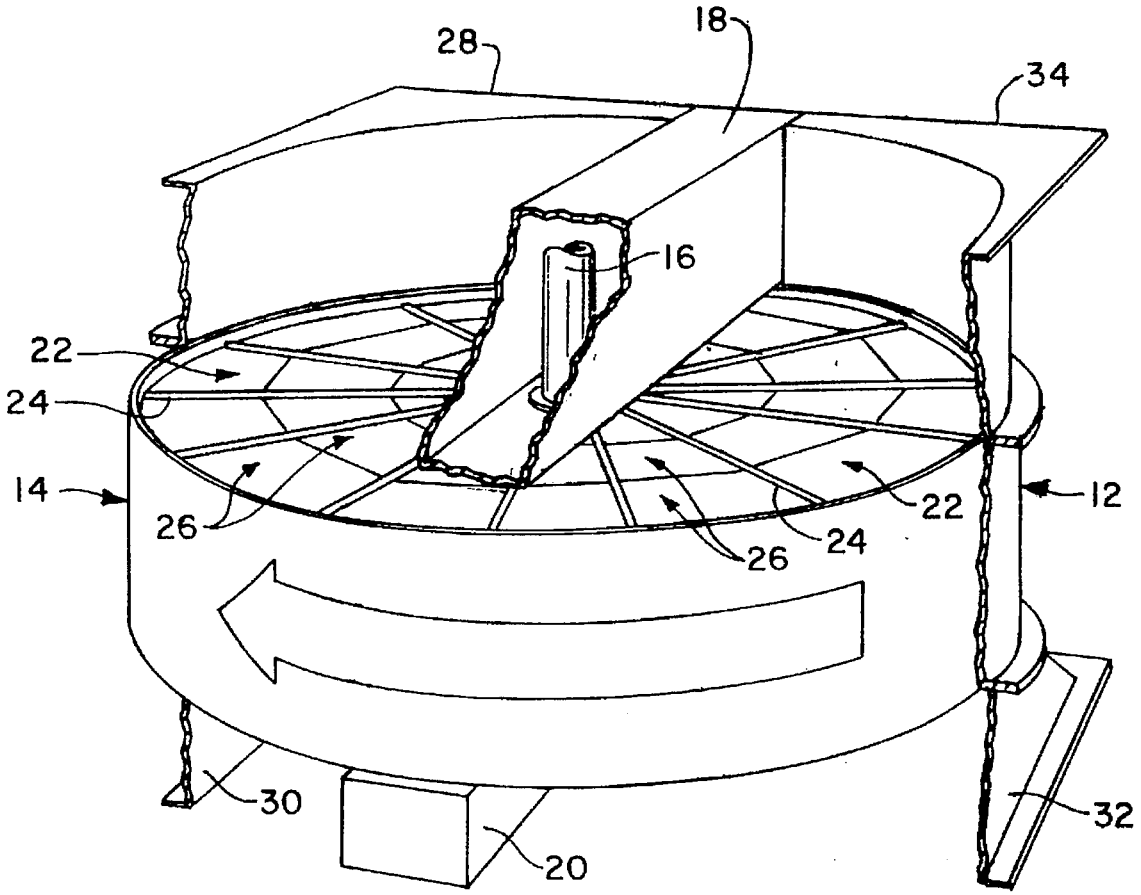
FIG. 1 is a perspective view showing the general arrangement of one type of air preheater with which the present invention may be used.

FIG. 1 of the drawings is a perspective view of a typical air preheater merely intended to illustrate the general type of structure in which the present invention is used. The present invention may be applied to horizontal, vertical (cold end on the top) and vertical inverted (cold end on the bottom) air preheaters. FIG. 1 depicts a vertical air preheater with the cold end on the bottom. The air preheater comprises a rotor housing 12 in which is mounted the heat exchange rotor 14. The rotor is mounted for rotation on the shaft 16 which extends between the upper center section 18 and the lower center section 20. The rotor is divided into sectors 22 by the diaphragm plates 24 and heat exchange baskets 26 are stacked into these sectors 22. Located at the top and bottom of the air preheater and attached to the rotor housing 12 and to the top and bottom center sections 18 and 20, are the transition duct assemblies identified as 28, 30, 32 and 34. These transition duct assemblies attach the air preheater to the ducting for the air supply to and the flue gas from a steam generator or other combustion equipment. For example, the flue gas may enter the air preheater through transition duct 28, transfer the heat to the revolving rotor 14, and exit through transition duct 30. The combustion air enters through transition duct 32, picks up the heat from the rotor and exits through transition duct 34. These transition ducts are constructed to make the transition between the generally circular air preheater and the rectangular power plant ducts.

The problem that is encountered with air preheaters is that the flue gas which is flowing through the rotor often contains particulate material and/or condensible substances which can be deposited on the heat transfer surfaces in the baskets 26. This tends to clog up the air preheater and reduces the heat transfer efficiency. This problem is usually handled by providing sootblowing devices which travel across the face of the rotor as it is revolving and blow steam or air at high pressure onto the rotor and into the flow channels through the heat transfer surface to dislodge the deposits. Since most of the deposits occur at the cold end (exit of the flue gas), the sootblower is normally located at the cold end (the lower end of FIG. 1 ).

Figure 2:
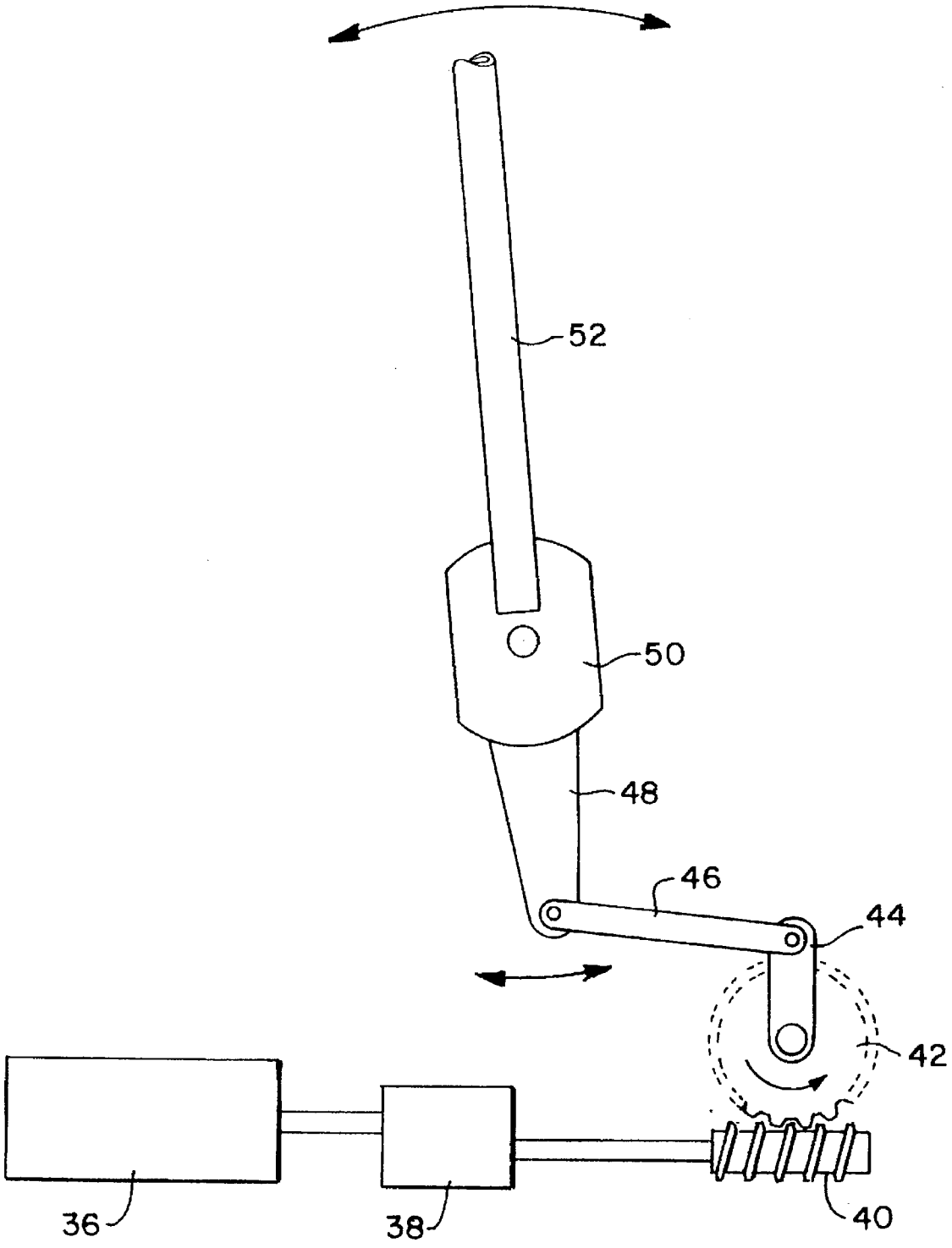
FIG. 2 PRIOR ART
FIG. 2 is a diagram illustrating one type of sootblower drive currently used on air preheaters.

FIG. 2 diagrammatically illustrates a typical prior art sootblower mechanism for an air preheater. A motor 36 is connected through a speed reducer 38 to a worm gear 40. The worm gear drives the worm wheel 42 and the lever throw arm 44. The connecting link 46 connects the lever throw arm 44 to a lever 48 which is attached to the rotatable sootblower lance mounting plate 50. The sootblower lance 52 is mounted to the rotatable plate 50. As the motor 36 and speed reducer 38 turn the worm gear 40, the worm wheel 42 and the lever throw arm 44 are rotated. The rotation of the lever throw arm 44 oscillates the connecting link 46 and the lever 48 back and forth. This causes the sootblower mounting plate 50 and the sootblower lance 52 to oscillate back and forth through an arc with the arc being selected to move the nozzle on the lance (not shown) to move essentially across the radius of the air preheater rotor.

As known, this type of linkage mechanism results in the speed or angular velocity of the lance to start out at one end of its arc of travel at zero velocity, to gradually increase in velocity to the center of the arc of travel and then to gradually slow down and reach zero velocity at the other end of its arc of travel. This results in the energy of the sootblowing medium being concentrated toward the ends of the arc of travel which would normally be the center portion and the outside edge of the rotor. This excess energy is greater than needed for sootblowing purposes and causes a more rapid and excessive deterioration of the heat exchange surface in these areas.

Another type of prior art sootblower for air preheaters is the linear retractable sootblower with a multiple nozzle lance. This is a sootblower with the lance being extendable and driven in a straight path across the face of the rotor and then retracted also in a straight path. Such sootblowers do maintain a constant speed but fall short in controlling the amount of energy applied to the heat exchange element. They use a plurality of set nozzle sizes distributed along the length of the lance to create cleaning zones for each nozzle. These set nozzle zones may impact on the useful life of the element. Furthermore, if the lance speed were to be made adjustable so that a specific zone of the element can be more effectively cleaned, it would also effect the speed of the nozzles in the other zones and apply more energy in zones where it is not needed.

The present invention overcomes the problem of changing speed or angular velocity and involves a sootblower and drive arrangement which results in the sootblower making a constant speed sweep across the face of the rotor and abruptly stopping while at the same time terminating the flow of sootblowing medium.

Figure 3:
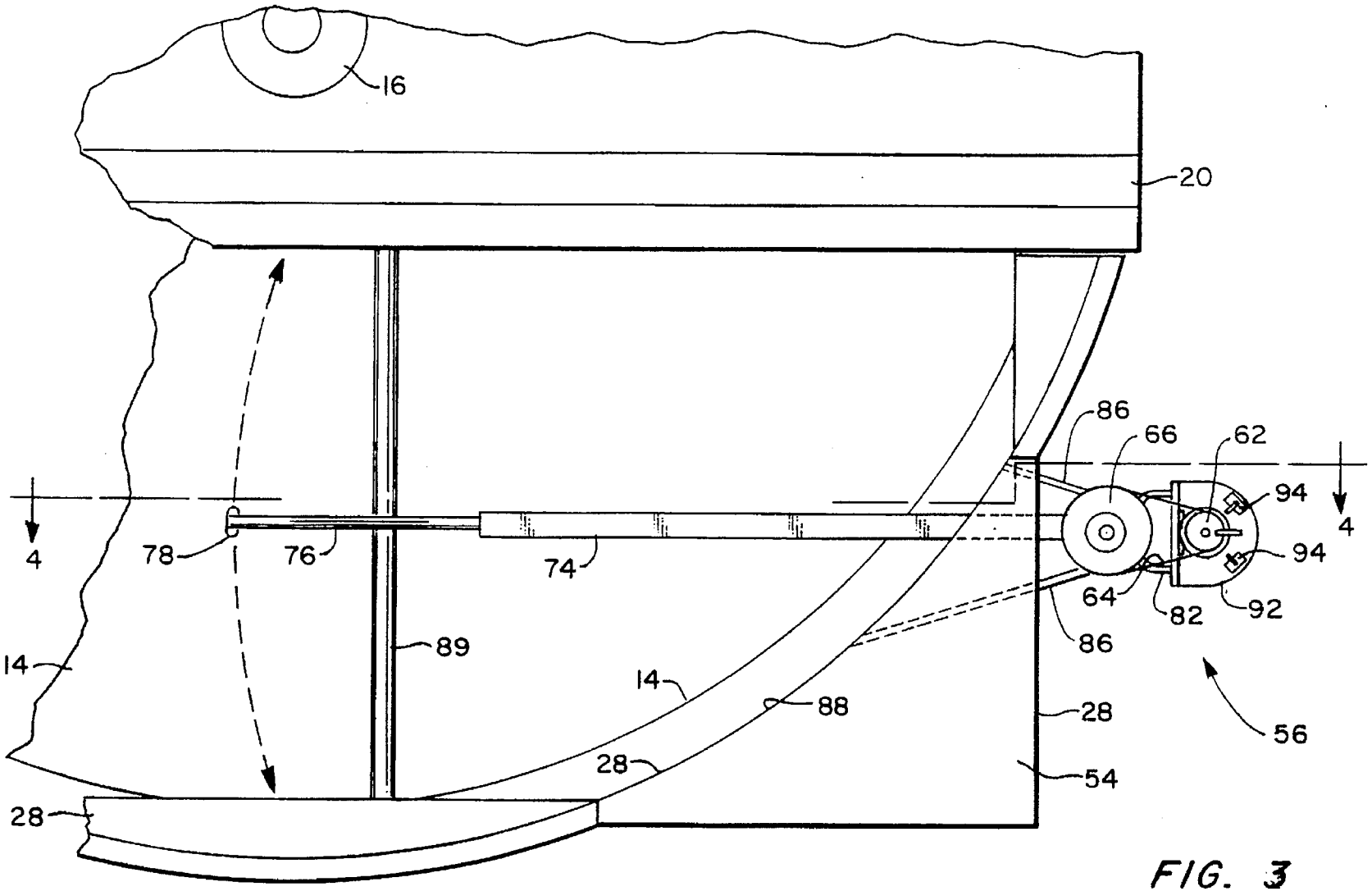
FIG. 3 is a bottom view of a segment of an air preheater illustrating the sootblower arrangement of the present invention.
Figure 4:
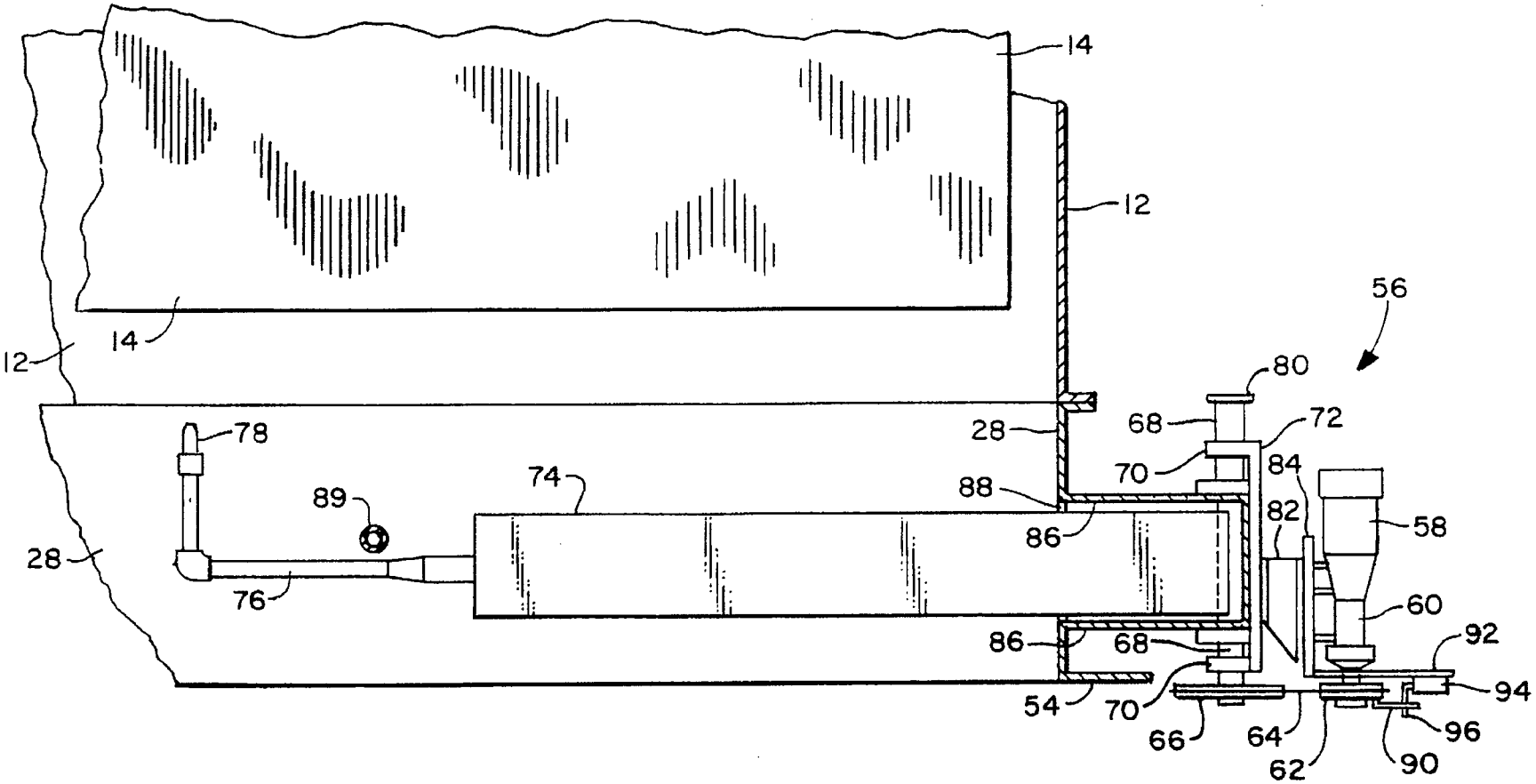
FIG. 4 is a cross-section view taken generally along line 4—4 of FIG. 3 and illustrating a quadrant of the lower portion of the air preheater.

Illustrating the present invention, FIG. 3 is a bottom view of one quadrant of an air preheater similar to that shown in FIG. 1 and FIG. 4 is a vertical cross section view taken along line 4—4 of FIG. 3. The air preheater comprises a rotor housing 12, a rotor 14, a rotor shaft 16 and a lower end center section 20. Attached to the side of the lower end center section 20 and attached to the lower edge of the rotor housing 12 is the transition duct 30. This transition duct 30 includes the flat horizontal plate section 54 so that the transition duct is adapted to mate with the power plant ducting.

Attached to the outside of the transition duct 30 is the sootblower drive mechanism which is generally designated 56. The drive mechanism comprises a motor 58 which is connected through a speed reducer 60 to drive sprocket 62. The drive sprocket 62 preferably includes a torque-limiter clutch which will disengage the drive in the event that the sootblower lance (or any other part of the mechanism) becomes hung-up or jammed. The drive sprocket 62 is connected by the drive chain 64 to the driven sprocket 66.

Driven sprocket 66 is mounted to the rotatable pipe shaft 68 which is mounted by the bearing blocks 70 to the backing plate 72. Also attached to the shaft 68 is the sootblower lance assembly which comprises the rectangular pipe support 74 and the lance pipe 76 which terminates at the sootblower nozzle 78. The lance pipe 76 communicates with the inside of the pipe support 74 which in turn communicates through appropriate openings to the inside of the shaft 68. At the bottom end of the shaft 68 is a flange 80 for attachment to the source of the sootblowing medium. The bracket 82 supports the motor mounting plate 84 from the backing plate 72. As the motor 58 rotates the sprockets 62 and 66, the shaft 68 is rotated and swings the sootblower lance assemble, which is attached to the shaft 68, through a preselected arc as shown by the arc in FIG. 3.

The entire sootblower drive mechanism 56 is mounted to the side of the transition duct 30 by means of the plate assembly 86 which comprises a generally wedge-shaped box having top and bottom plates as shown in FIG. 4 and two side plates as shown in FIG. 3. One end of these plates is attached and sealed to the backing plate 72 with the other ends being attached and sealed to the transition duct 30. The transition duct 30 has an opening 88 whereby the inside of the plate assembly 86 communicates with the inside of the air preheater. This opening 88 is of such a size and configuration to permit the sootblower lance assembly to swing through its arc. The sealing of the plate assembly 86 to both the backing plate 72 and the transition duct 30 prevents any leakage from the air preheater to the atmosphere.

Extending across the rotor between the center section 20 and the duct 30 is a guard bar 89 seen in FIGS. 3 and 4. This guard bar 89 is located between the sootblower lance assembly and the rotor as close to the free end as practical without interfering with the nozzle. The purpose of this guard bar 89 is to restrict movement of the sootblower lance assembly and prevent possible contact with the rotor particularly when the sootblowing medium is turned on or off which can cause significant oscillation of the lance.

As an example, an air preheater with a rotor having a diameter of about 22 feet will have a sootblower lance assembly of about 11 feet and will have a cycle time of about 17 minutes (this is the time of travel through the arc in one direction.) In order to cover the entire rotor, the lance assembly will swing through an arc of about 39°. It can also be noted that air preheater rotors have a speed which can range between about 1 and 4 RPM usually depending upon size with larger rotors rotating slower.

Figure 5:
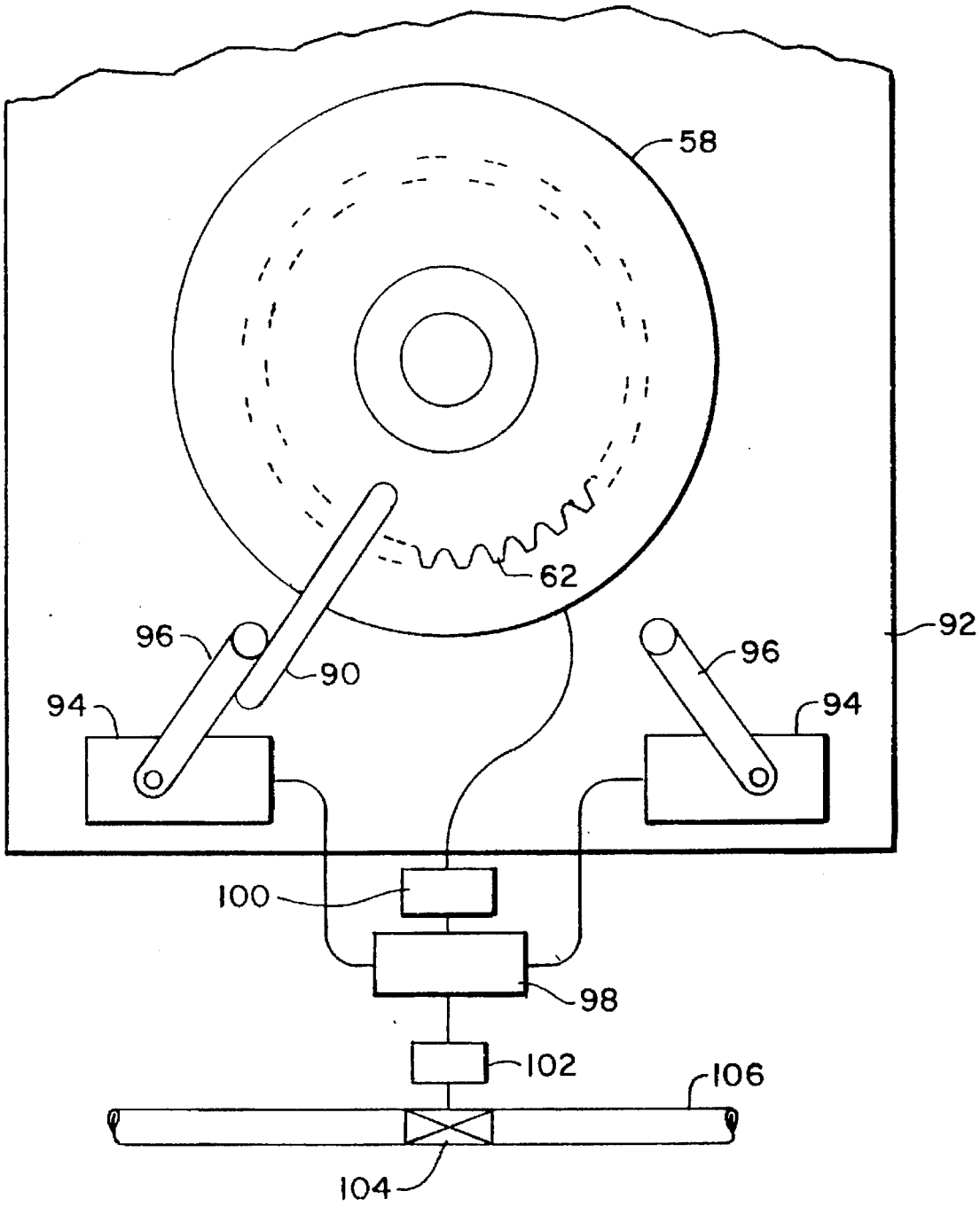
FIG. 5 is a more detailed view of the drive unit illustrating the drive sprocket and limit switches together with the control arrangement.

Shown in FIG. 4 but in more detail in FIG. 5 is the means for setting the arc of travel of the lance assembly. Also shown in FIG. 5 is means for initiating and terminating the flow of sootblowing medium. Mounted on the drive sprocket 62 is a trip bar 90. Mounted on the plate 92 are two limit switches 94 each having a switch lever 96. As the sprocket 62 rotates, the trip bar 90 rotates between the limit switches 94. At the preselected end of travel through the arc, the trip bar 90 engages a switch lever 96 and turns off the switch. The switches are connected through the control unit 98 to the motor 58 and when the limit switch 94 turns off, the motor stops. Also, means may be provided to adjust the motor speed in general or to program the motor speed to vary at particular points during its sweep. For this purpose, the motor 58 is preferably a variable speed AC motor and the control unit 98 is connected to the motor 58 through the AC motor speed controller 100. This speed controller 100 (which in fact may be integral with the control unit 98) may be used to adjust the speed to any desired level and may be used in conjunction with the control unit 98 to program the lance to speed up or slow down at desired points or times in the arc to compensate for particular patterns of deposits in the element. The control unit 98 is also adjustable to control the interval between each sootblowing operation. Likewise, the control unit 98 is connected to the valve operator 102 which controls the valve 104 in the sootblower medium supply line 106. When the motor 58 is turned off, the control unit also shuts the valve 104. The limit switches 94 are movably mounted on the plate 92 so that their position can be adjusted to control the sweep of the sootblower lance assembly.

We claim:

1. A sootblower arrangement for a rotary regenerative air preheater having a heat exchange rotor with a center portion and a peripheral portion and comprising:

a. a drive motor, b. a speed reducer connected to said drive motor including an output shaft, c. a rotatable drive means attached to said speed reducer output shaft rotatable at a constant speed proportional to the speed of said drive motor, d. a rotatable driven means connected to an oscillatable swivel shaft, e. means for driving said rotatable driven means and said oscillatable swivel shaft from said rotatable drive means at a constant speed proportional to the speed of said rotatable drive means, f. a sootblower arm attached to said oscillating swivel shaft, said sootblower arm extending over a portion of said heat exchange rotor and adapted to swing through an arc extending between an end point adjacent said center portion of said rotor and an end point adjacent said peripheral portion of said rotor, and g. means for turning said drive motor off as said sootblower arm reaches one of said end points of said arc.

2. A sootblower arrangement as recited in claim 1 wherein said rotatable drive means and said rotatable driven means are sprockets and wherein said means for driving is a chain.

3. A sootblower arrangement as recited in claim 1 wherein said drive motor is a variable speed motor and further including means for varying the speed of said drive motor to vary the speed of the swing of said sootblower arm through said arc.

4. A sootblower arrangement as recited in claim 3 and further including means for varying the speed of the sootblower arm within a selected portion of the swing through said arc.

5. A sootblower arrangement as recited in claim 1 wherein said means for turning said drive motor off includes a trip bar attached to rotate with said rotatable drive means and a pair of limit switches positioned to be tripped by said trip bar as said sootblower arm reaches an end point of said arc.

6. A sootblower arrangement as recited in claim 5 wherein said limit switches are movable to control said end points.

7. A sootblower arrangement as recited in claim 1 wherein said rotary regenerative air preheater includes a plurality of transition duct assemblies attached thereto for conducting flue gas and air into and out of said air preheater and wherein said sootblower arrangement is mounted on the outside of one of said transition duct assemblies and wherein said sootblower arm extends through an opening in said transition duct assembly.

8. A sootblower arrangement as recited in claim 7 and further including means sealingly attached to said transition duct assembly and to said sootblower arrangement to seal said opening from the atmosphere.

* * * * *